US006786380B2

(12) United States Patent
Driscoll et al.

(10) Patent No.: US 6,786,380 B2
(45) Date of Patent: Sep. 7, 2004

(54) TRIM-TYPE FASTENER DRIVING TOOL

(75) Inventors: Patrick J. Driscoll, Prospect Heights, IL (US); Robert Scott Buetow, Lake In The Hills, IL (US); Marc Largo, Gurnee, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/261,795

(22) Filed: Oct. 1, 2002

(65) Prior Publication Data

US 2003/0024961 A1 Feb. 6, 2003

Related U.S. Application Data

(62) Division of application No. 09/845,422, filed on Apr. 30, 2001, now Pat. No. 6,651,862.

(51) Int. Cl.[7] ..... B25C 1/08

(52) U.S. Cl. ..... 227/127; 227/10; 227/120; 227/123; 227/156; 16/430

(58) Field of Search ..... 227/120, 123, 227/127, 128, 130, 9, 10, 156; 16/430, 431, 111.1

(56) References Cited

U.S. PATENT DOCUMENTS

| | | | | |
|---|---|---|---|---|
| 2,206,460 | A | | 7/1940 | Hansen |
| 4,436,236 | A | | 3/1984 | Jobe |
| 4,942,996 | A | | 7/1990 | Wolfberg et al. |
| 5,163,596 | A | | 11/1992 | Ravoo et al. |
| 5,238,168 | A | | 8/1993 | Oda |
| 5,350,103 | A | | 9/1994 | Monacelli |
| 5,427,298 | A | | 6/1995 | Tegtmeier |
| 5,452,835 | A | | 9/1995 | Shkolnikov |
| 5,529,233 | A | * | 6/1996 | Davignon et al. ..... 227/67 |
| 5,687,899 | A | * | 11/1997 | Dohi et al. ..... 227/130 |
| 5,839,638 | A | | 11/1998 | Ronn |
| 5,909,836 | A | * | 6/1999 | Shkolnikov et al. ..... 227/130 |
| 6,012,622 | A | * | 1/2000 | Weinger et al. ..... 227/120 |
| 6,036,072 | A | * | 3/2000 | Lee ..... 227/120 |
| 6,093,900 | A | * | 7/2000 | Wisskirchen et al. .... 200/302.2 |
| 6,179,192 | B1 | | 1/2001 | Weinger et al. |
| 6,223,966 | B1 | * | 5/2001 | Nayrac et al. ..... 227/130 |
| 6,267,284 | B1 | * | 7/2001 | Clark ..... 227/120 |
| 6,276,078 | B1 | * | 8/2001 | Beverly et al. ..... 38/90 |
| 6,321,990 | B1 | * | 11/2001 | Giordano et al. ..... 235/472.01 |
| 6,378,402 | B1 | * | 4/2002 | Kalomeris et al. ..... 81/177.5 |
| 6,502,648 | B2 | * | 1/2003 | Milbourne ..... 173/178 |
| 6,523,380 | B1 | * | 2/2003 | McGuire et al. ..... 70/408 |

FOREIGN PATENT DOCUMENTS

| | | |
|---|---|---|
| EP | 0 804 985 | 11/1997 |
| JP | 61 209884 | 9/1986 |

* cited by examiner

*Primary Examiner*—Louis Huynh
(74) *Attorney, Agent, or Firm*—Lisa M. Soltis; Mark W. Croll; Donald J. Breh

(57) ABSTRACT

A powered tool constructed to drive a fastener into a workpiece includes a nosepiece assembly including a back plate and a front plate combining to define a path for a driver blade, the front plate being pivotally movable relative to the back plate between a closed position, in which the front plate and the back plate are in contact with each other, and an open position. The front plate is movable to an interim deflecting position between the closed position and the open position. A handle portion has an outer surface at least partially defining a grip, and an inner surface at least partially defining a chamber. The handle portion includes a substrate having at least one aperture, and an overmold configured for forming a gripping surface on the outer surface and for extending through the apertures into the chamber for forming a resilient mounting point.

6 Claims, 5 Drawing Sheets

TRIM-TYPE FASTENER DRIVING TOOL

This application is a division of U.S. patent application Ser. No. 09/845,422 filed Apr. 30, 2001 now U.S. Pat. No. 6,651,862.

BACKGROUND OF THE INVENTION

The present invention relates generally to improvements in fastener driving tools, and specifically to such tools used in the installation of trim, other decorative applications and finishing applications utilizing relatively small fasteners, fasteners made of relatively thin wire stock, and/or used with relatively small and/or delicate workpieces. The foregoing will generally be referred to as "trim applications." Included in the present tool are several features intended to make the manufacture, use and/or repair of such tools more efficient.

Portable combustion powered tools for use in driving fasteners into workpieces are described in commonly assigned patents to Nikolich, U.S. Pat. Nos. Re. 32,452; 4,403,722; 4,483,473; 4,483,474; 4,552,162; 5,197,646 and 5,263,439, all of which are incorporated herein by reference. Such combustion powered tools particularly designed for trim applications are disclosed in commonly assigned U.S. Pat. No. 6,016,622, also incorporated by reference herein. Similar combustion powered nail and staple driving tools are available from ITW-Paslode under the IMPULSE® brand.

Such tools incorporate a generally pistol-shaped tool housing enclosing a small internal combustion engine. The engine is powered by a canister of pressurized fuel gas also called a fuel cell. A battery-powered electronic power distribution unit or electronic sending unit produces the spark for ignition, and a fan located in the combustion chamber provides for both an efficient combustion within the chamber, and facilitates scavenging, including the exhaust of combustion by-products. The engine includes a reciprocating piston having an elongate, rigid driver blade disposed within a piston chamber of a cylinder body.

A wall of the combustion chamber is axially reciprocable about a valve sleeve and, through a linkage, moves to close the combustion chamber when a workpiece contact element at the end of a nosepiece, or nosepiece assembly, connected to the linkage is pressed against a workpiece. This pressing action also triggers the introduction of a specified volume of fuel gas into the combustion chamber from the fuel cell.

Upon the pulling of a trigger, which causes the ignition of the gas in the combustion chamber, the piston and the driver blade are shot downward to impact a positioned fastener and drive it into the workpiece. As the piston is driven downward, a displacement volume enclosed in the piston chamber below the piston is forced to exit through one or more exit ports provided at a lower end of the cylinder. After impact, the piston then returns to its original or "ready" position through differential gas pressures within the cylinder. Fasteners are fed into the nosepiece from a supply assembly, such as a magazine, where they are held in a properly positioned orientation for receiving the impact of the driver blade.

One operational characteristic of such tools employed in trim applications is that commercially available fasteners are typically provided in elongate strips of individual fasteners held together with adhesive, not unlike conventional office staples. It is common for such fasteners to become jammed in the nosepiece. Thus, provisions are made in known trim-type fastener driving tools for the user to access the interior of the nosepiece to remove the jammed fasteners.

In one known embodiment, a front plate of the nosepiece assembly is pivotable outward to permit full access to the interior of the nosepiece. The front plate is preferably pivotable to at least 90° relative to the vertical operational axis of the tool for enabling the operator to pull out the jammed fasteners perpendicularly to the action of the piston. One drawback of such an arrangement is that if the operator neglects to relieve the spring pressure of the magazine against the fasteners, once the jam is cleared, additional fasteners may be uncontrollably ejected from the nosepiece, potentially causing injury or damage.

Another operational characteristic of known trim-type fastener driving tools is that, to avoid user fatigue, designers are constantly trying to improve the ergonomics of the tool, including reducing weight and adjusting balance. One aspect of such a design objective is that the nosepiece has been moved closer to the combustion chamber to reduce the height of the tool. A drawback of this type of design is that the pivoting action of the front plate is restricted, and can no longer reach a fully open position. This restricts access to the jammed fasteners, in that the user must work around the partially-opened front plate to access the jam. However, an advantage of this restricted pivoting action is that if the magazine spring force has not been disconnected, upon clearing of a jam, fasteners ejected from the nosepiece are deflected by the front plate to avoid injury and/or damage.

Another operational characteristic of such tools is that significant impact forces are generated in the combustion and driving of the driver blade. Also, the tools are sometimes dropped from a height during use or transport. These impacts have been known to damage the sensitive electronic components of the tool, such as, but not limited to the electronic sending unit. To reduce such impacts, it is known to apply a shock absorbing caulk around the sending unit, which in some tools is located inside the handle portion. However, a drawback of this technique is that the caulk is messy to apply during manufacturing, and also makes service and repair of the sending unit more difficult.

Still another operational characteristic of such tools is that it is important to avoid firing the tool when the magazine is empty of fasteners. If so, the driver blade can cause a mark in the workpiece, which is very undesirable in appearance-intensive trim applications. It is known to provide magazines with indicators of the impending depletion of the fasteners in the magazine. However, these known devices do not provide the number of fasteners remaining just prior to the emptying of the magazine. Since operators of such tools often change the type and/or length of fasteners, it is desirable to have an accurate indication of when the magazine will become depleted.

Thus, it is an object of the present invention to provide an improved fastener driving tool which provides for the deflection of ejected fasteners upon the clearance of a fastener jam, and also is fully openable for the clearance of more complicated jams, or jams of longer fasteners.

Another object of the present invention is to provide an improved fastener driving tool which has a relatively short profile, but is also fully accessible for clearing jammed fasteners.

Still another object of the present invention is to provide an improved fastener driving tool in which the handle portion provides shock absorption to the electronic sending unit without the use of shock absorbing caulk.

A further object of the present invention is to provide an improved fastener driving tool having a fastener magazine with an indicator of the number of fasteners remaining just before the magazine is depleted.

BRIEF SUMMARY OF THE INVENTION

The above-listed objects are met or exceeded by the present trim-type fastener driving tool, which features a front plate which is pivotable relative to the nosepiece to permit access, and which has two jam clearing positions: a first position which deflects fasteners ejected after the jam is cleared, and a second, fully accessible open position which permits axial extraction of jammed fasteners. In addition, the handle portion is preferably provided in its interior with a resilient cushion for protecting a delicate item stored within the handle, such as an electronic sending unit, which avoids the use of shock-absorbing caulk. Preferably, the cushion is part of a resilient gripping surface found on the outside of the handle. Also, the magazine is preferably provided with an indicator of the number of fasteners remaining just before the magazine becomes depleted.

More specifically, a powered tool constructed to axially drive a driver blade to impact and drive a fastener into a workpiece includes a nosepiece assembly including a back plate and a front plate combining to define a path for the driver blade, the front plate being pivotally movable relative to the back plate between a closed position, in which the front plate and the back plate are in contact with each other, and an open position. The front plate is movable to an interim deflecting position between the closed position and the open position.

In an alternate embodiment, a powered tool constructed to axially drive a driver blade to impact and drive a fastener into a workpiece includes a handle portion with an outer surface at least partially defining a grip, and an inner surface at least partially defining a chamber, preferably for an electronic sending unit. The handle portion includes a substrate having at least one aperture, and an overmold configured for forming a gripping surface on the outer surface, the overmold also being configured for extending through at least one of the apertures into the chamber for forming at least one resilient mounting point for the electronic sending unit.

In a further alternate embodiment, a powered tool constructed to axially drive a driver blade to impact and drive a fastener into a workpiece includes a nosepiece assembly including a back plate defining an aperture through which fasteners are fed for engagement with the driver blade, a front plate at least partially covering the aperture, and a magazine for dispensing fasteners to the aperture. The magazine has an indicator for indicating how many fasteners are remaining just prior to the magazine becoming empty.

DETAILED DESCRIPTION OF THE INVENTION

Figure 1:
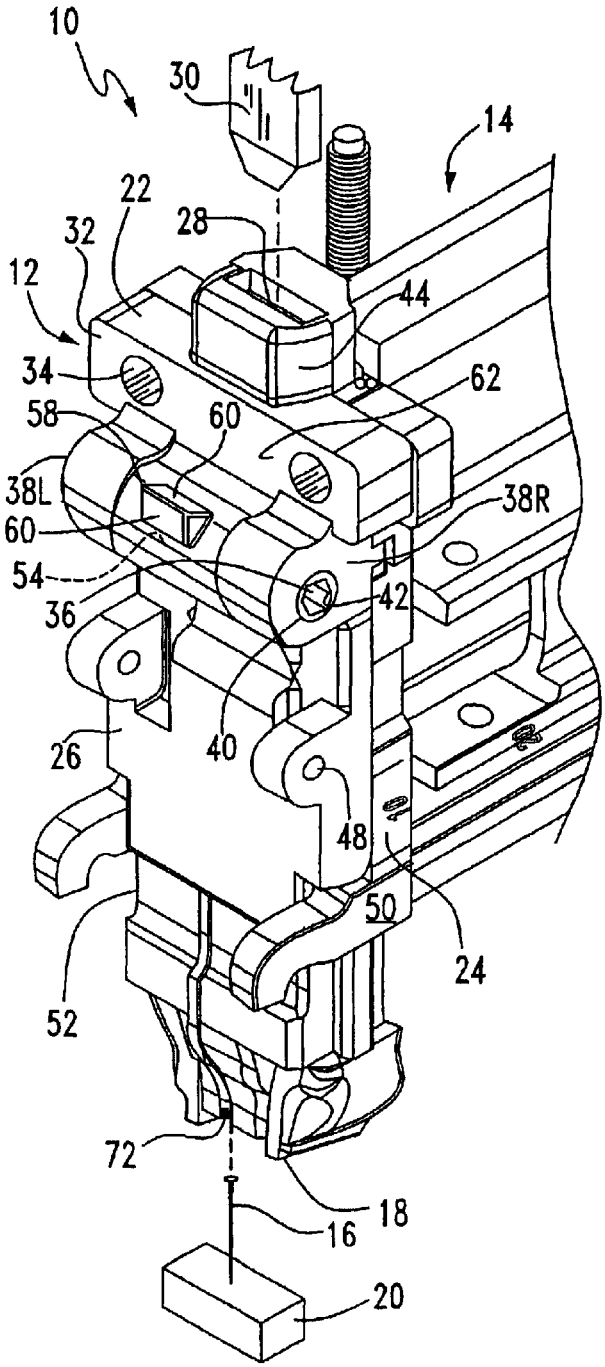
FIG. 1 is a fragmentary perspective view of the present tool, illustrating the nosepiece assembly and the magazine.
Figure 2:
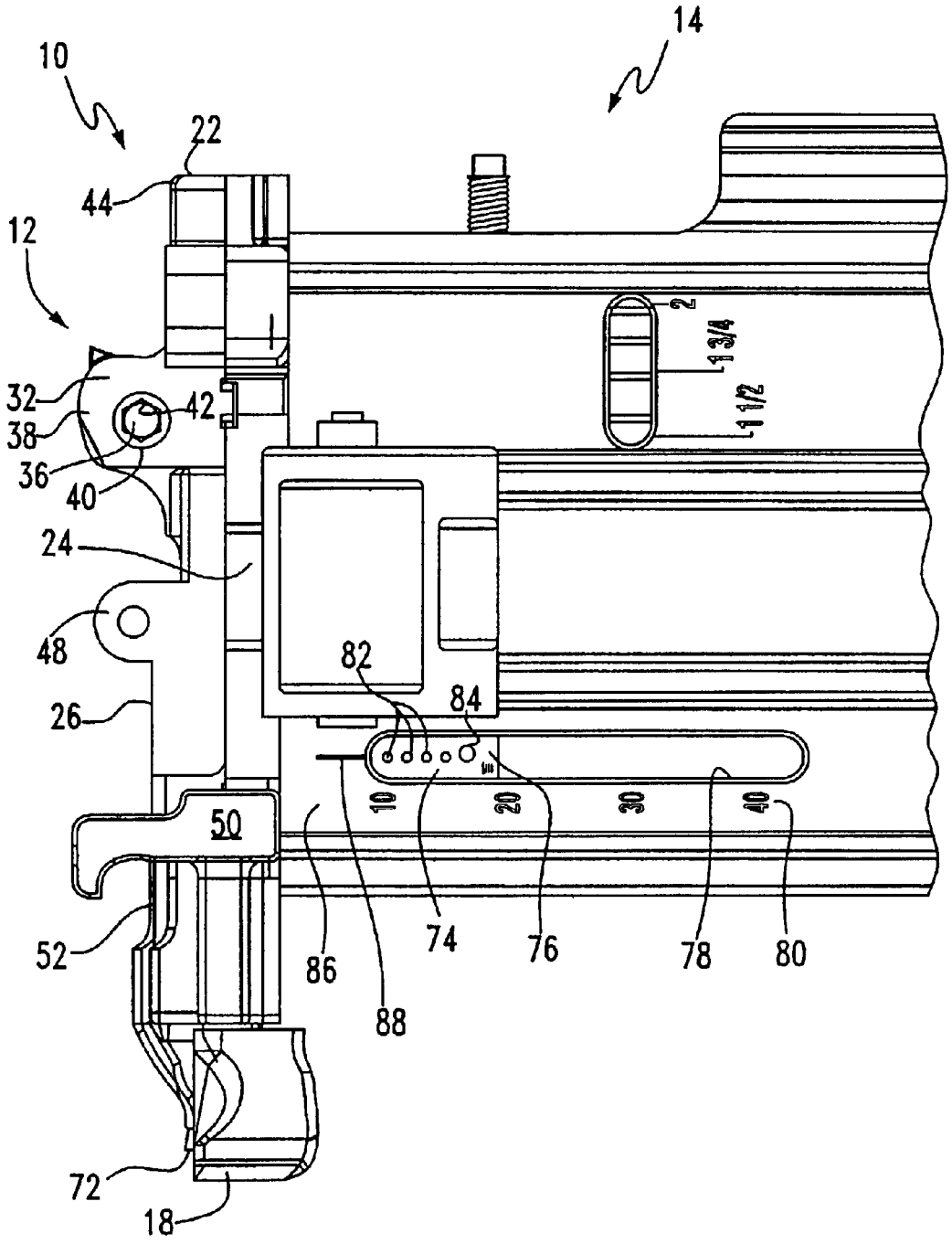
FIG. 2 is a side view of the structure of FIG. 1.

Referring now to FIGS. 1 and 2, a combustion powered tool suitable for driving trim-type fasteners is fragmentarily shown and generally designated 10. It will be understood that features described below are particularly suitable for trim-type fasteners, however it is also contemplated that they may find application with combustion powered tools used for other applications. The general appearance and operational details of such combustion powered tools for both general and trim-type applications are described in greater detail in the patents which have been incorporated by reference.

In FIG. 1, the main illustrated components are a nosepiece assembly 12 and a fastener magazine 14. The tool 10 is shown in a generally vertical orientation, with fasteners 16 driven through a lower end 18 of the nosepiece assembly 12 into a workpiece 20, however other orientations of the tool 10 are contemplated as known in the art. Opposite the lower end 18 is an upper end 22 of the nosepiece assembly 12.

Included in the nosepiece assembly 12 are a generally planar back plate 24 and a generally planar front plate 26, which combine to define a path or track 28 for a driver blade 30. The track 28 extends the full length of the nosepiece assembly 12 to the lower end 18. A front plate support 32 is secured to the back plate 24, preferably by fasteners (not shown) passing through corresponding bores 34 in the support and the back plate. The main purpose of the front plate support 32 is to provide a pivot point or axis 36 for the front plate 26. However, other arrangements providing such a pivot axis are contemplated, including providing a pivot point integrally formed on the back plate 24. In the preferred embodiment, the pivot axis 36 is defined by a pair of spaced, co-axial bosses 38 each defining a throughbore 40. At least one of the throughbores 40 is internally threaded or otherwise configured for lockingly receiving a pivot pin 42. An upper end 44 of the front plate support 32 also helps define the track 28.

As described above, an important concern of users of such fastener tools 10 is that there should be access to the interior of the nosepiece assembly 12 to enable the clearance of jammed fasteners. Specifically, there is an aperture 46 (shown hidden in FIG. 3) in the back plate 24 through which fasteners 16 are urged from the magazine 14. This aperture 46 often becomes filled or jammed with at least one fastener 16 and must be cleared for the resumption of normal operation of the tool 10. In the preferred embodiment, such access is obtained by having the front plate 26 be pivotable relative to the back plate 24.

Figure 3:
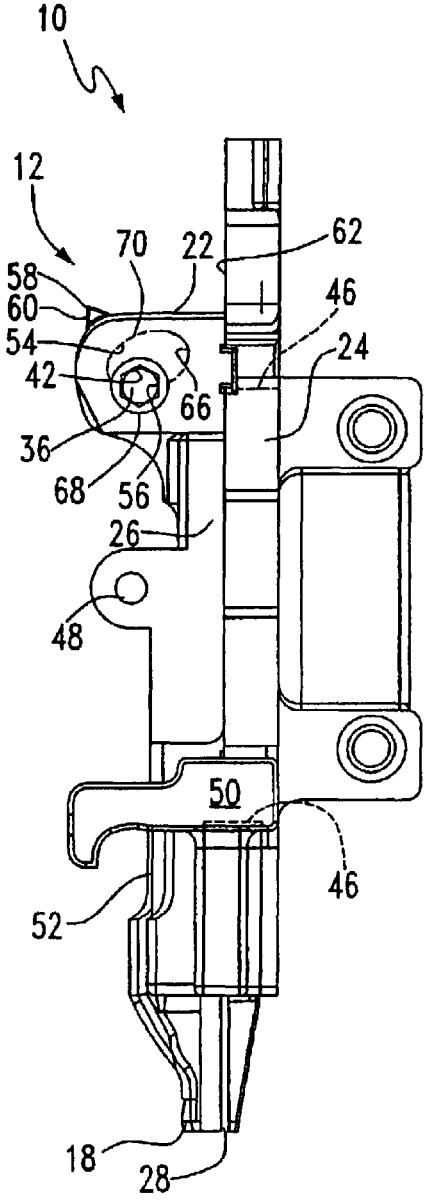
FIG. 3 is a side view of the tool of FIG. 1, with portions omitted for clarity.

Referring now to FIGS. 1–3, this pivoting action begins from a closed position in which the front plate 26 and said back plate 24 are in contact with each other, which is also the normal operating position of the tool 10. The closed position is maintained by a releasable spring clamp (not shown) which, in the preferred embodiment, is an over-center cam type well known in the art of trim-type fasteners for this purpose. The clamp is mounted to eyelets 48 on the front plate 26, retainer arms 50 on the back plate 24, and a recess 52, also located on the front plate. Other mounting formations are contemplated for securing any suitable clamp in operational relationship to the nosepiece assembly 12.

In the preferred embodiment, the pivoting action is obtained by an upper end of the front plate 26 being provided with a pivot bore 54 which is preferably noncircular, and which accommodates the pivot pin 42. The pin is shown with a hex recess 56, and is preferably threaded at its tip to engage the throughbore 40 in the left boss 38L, after it slidingly passes through the throughbore 40 in the right boss 38R and the pivot bore 54. While the above-described arrangement is preferred, other structures for obtaining a pivoting relationship between the front plate 26 and the rear plate 24 are contemplated, such as, but not limited to having the pin 42 fixed to the front plate and engaged in U-shaped grooved bores 40, having two bores 40 on the front plate and the pivot bore 54 on the rear plate, and having the two bores 40 located elsewhere on the nosepiece assembly 12 or on the tool 10.

Figure 7:
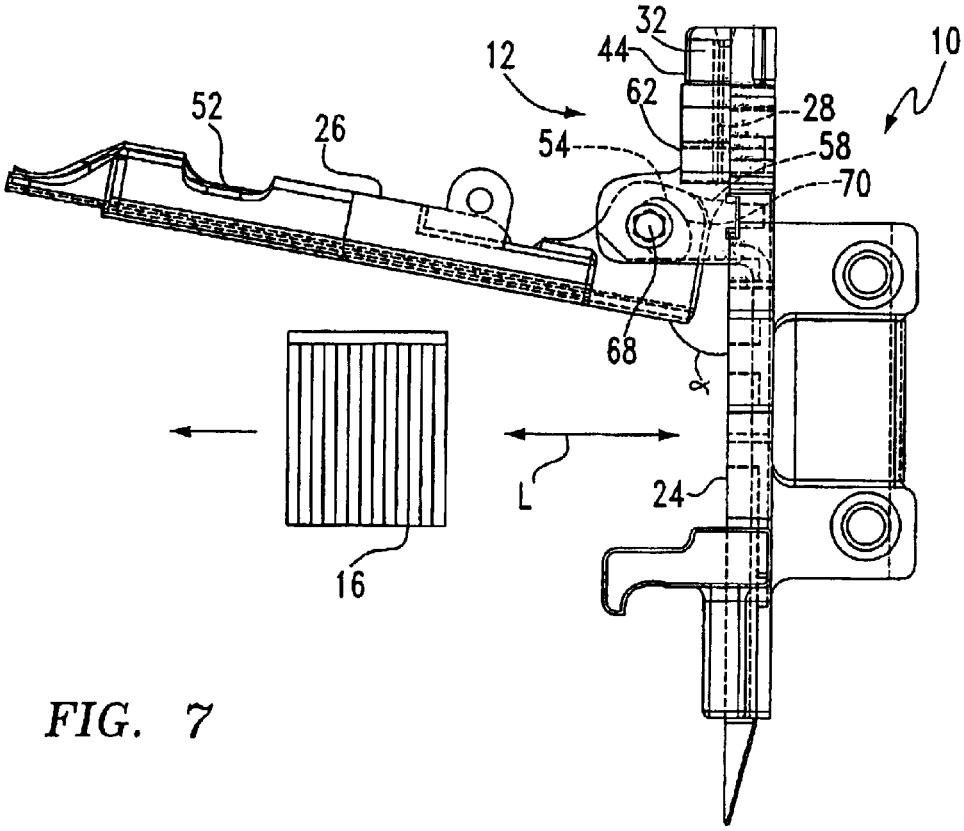
FIG. 7 is a view of the tool of FIG. 4 shown in a fully opened position.

Referring now to FIGS. 3 and 7, the front plate 26 is generally freely pivotable between the closed position (FIG. 3) and an open position (FIG. 7). In the present application, the "open position" will be referred to as a fully open position of the front plate 26 in which fasteners 16 jammed in the aperture 46 are extractable along a longitudinal axis "L" (FIG. 7) generally perpendicular to the plane of the back plate 24. In the preferred embodiment, the front plate 26 in the open position is at an angle $\alpha$ of least 90°, however other angles are contemplated depending on the height of the fasteners 16.

As described above, one drawback of prior art trim-type tools is that in some cases, the user forgets to release the spring bias exerted by the magazine 14 against the fasteners 16 ready to be driven by the driver blade 30. Upon the extraction of the jammed fastener, the remaining fasteners (sometimes in strip form, as seen in FIG. 7) can be ejected from the aperture 46 under force, which may cause injury and/or damage.

Referring to FIG. 1, an important feature of the present nosepiece assembly 12 is a stop 58 configured for preventing the otherwise free pivoting action of the front plate 26 to the open position and creating an interim deflecting position for the front plate 26 between the closed position and the open position.

In the preferred embodiment, the stop 58 is secured to the front plate 26, preferably integrally, and projects generally radially from the pivot bore 54. The stop 58 also takes the general form of a right angle, having a pair of walls 60. Other types of attachment and configuration for the stop 58 are contemplated as are known in the art for enabling the stop to engage the nose assembly 12 for preventing the front plate 26 from reaching the open position.

Figure 4:
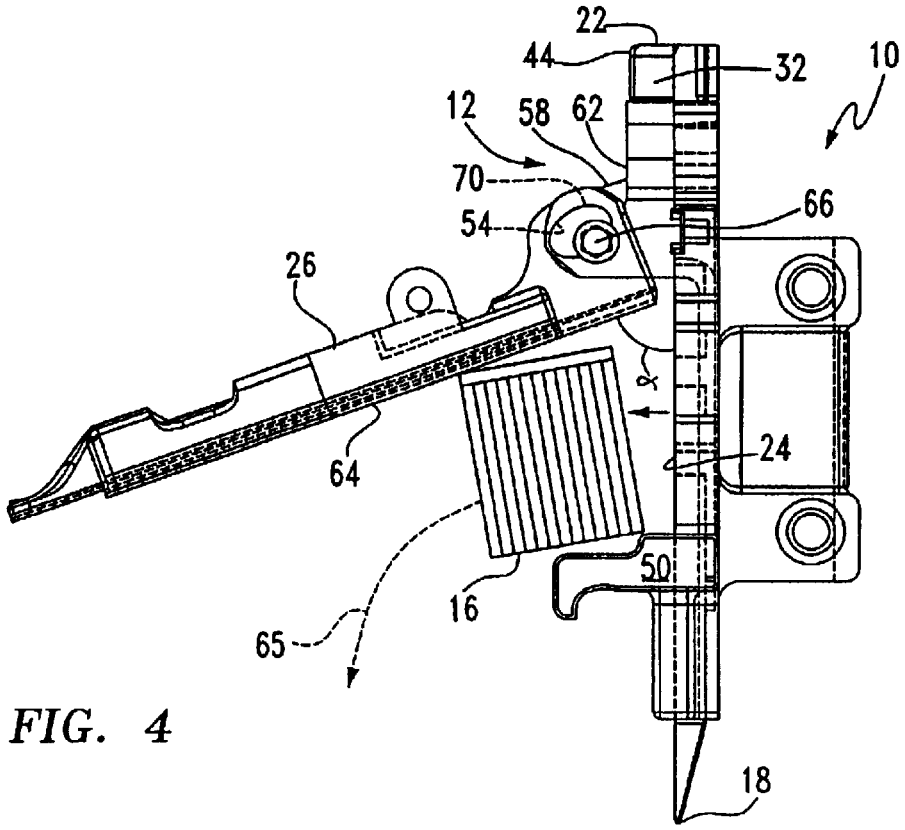
FIG. 4 is a side view of the tool of FIG. 1 illustrating the deflection position.
Figure 5:
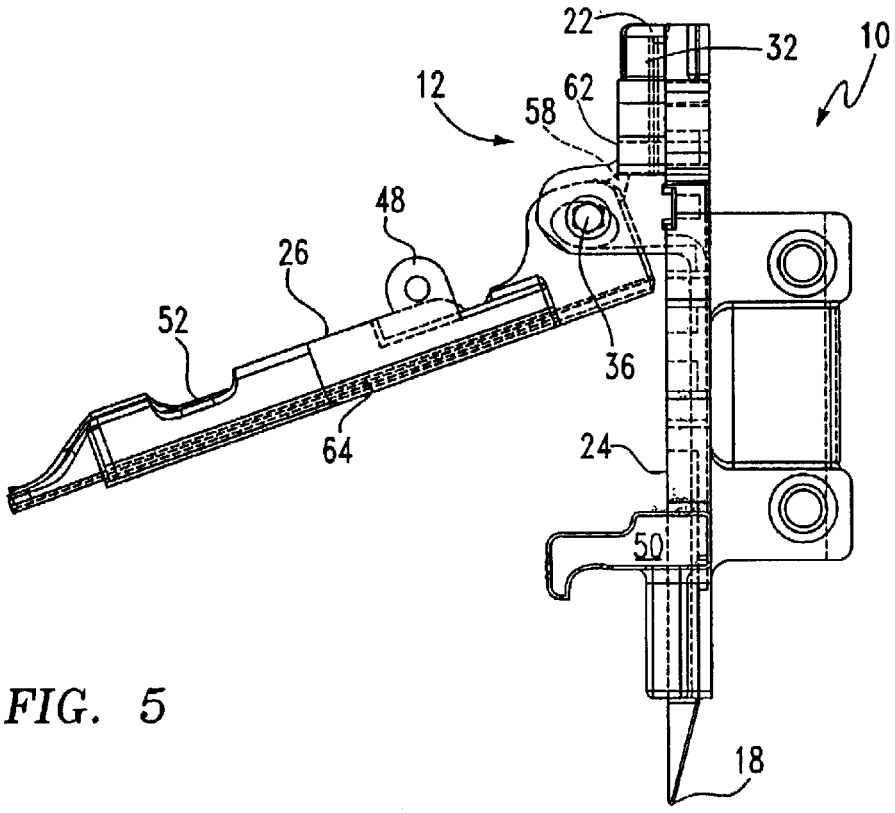
FIG. 5 is a view of the tool of FIG. 4 shown in a first partially disengaged position.

Referring now to FIGS. 1 and 4, the stop 58 engages a surface 62 on the front place support 32 to define an interim or deflection position. This position is so named because of the way an inner surface 64 of the front plate 26 will deflect any ejected fasteners 16 which are released by the user pulling the jammed fastener from the aperture 46. The deflection position, in which an angle $\alpha$ is preferably in the range of 69–70°, tends to protect the user and surrounding property from injury and/or damage from ejected fasteners. A fragmentary fastener strip 16 is shown being ejected and deflected along a path 65. The deflection position is also useful in deflecting broken pieces of jammed fasteners which may be ejected from the aperture 46. In addition, in many cases a jam may be cleared without opening the front plate 26 to the open position (FIG. 7).

Referring to FIGS. 1 and 3–7, another feature of the present tool 10 is that it has a relatively low profile, in that the nosepiece assembly 12 is mounted relatively close to the combustion chamber (not shown). Due to this arrangement, special efforts must be made to provide the front plate 26 with the ability to pivot fully to the open position (FIG. 7). In addition, to reach the open position, the nosepiece assembly 12 is preferably equipped with a structure for enabling the disengagement of the stop 58 from the surface 62.

In the preferred embodiment, the disengagement structure takes the form of the noncircular pivot bore 54, which defines a first pivot axis 66 for pivoting action to the deflecting position (FIG. 4), and a second pivot axis 68 (FIGS. 6 and 7) for enabling disengagement between the stop 58 and the surface 62 for achieving the open position. In addition, the pivot bore 54 also defines a transition surface 70 to allow the user to shift the front plate 26 downward and forward so that disengagement is achieved. This shift can be seen in FIG. 5, where it is evident that the stop 58 has now been moved beneath the surface 62.

Figure 6:
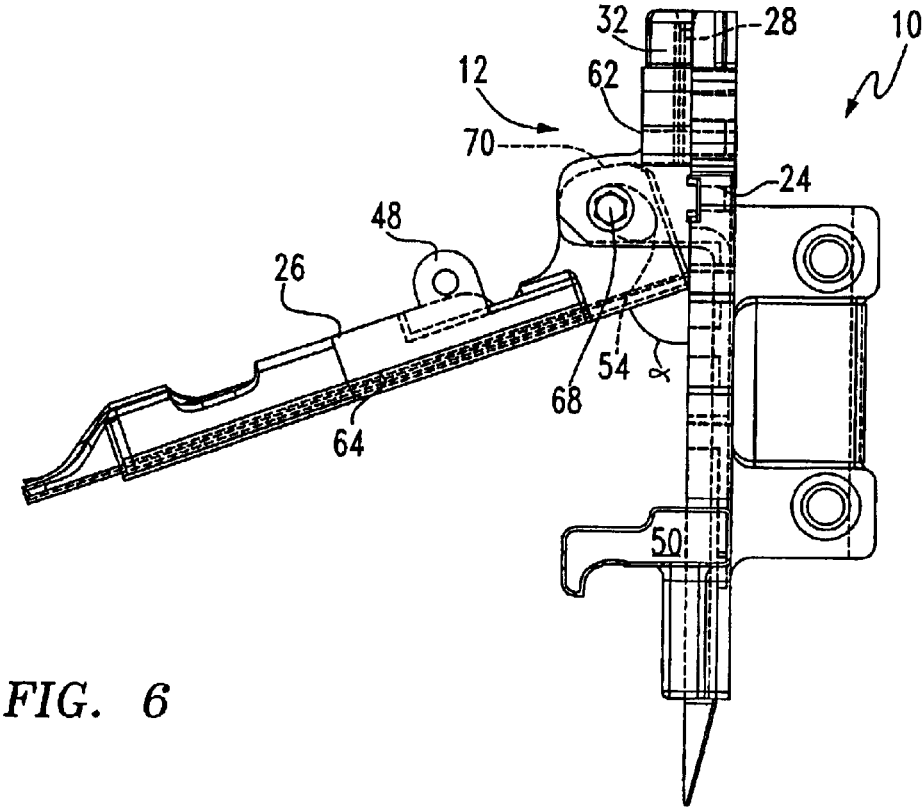
FIG. 6 is a view of the tool of FIG. 4 shown in a second partially disengaged position.

Referring now to FIG. 6, once disengagement has occurred, the front plate 26 is now free to pivot about the second axis 68 to the open position (FIG. 7), in which the stop 58 is totally out of contact with the front plate support 32. It will also be seen from FIG. 3 that the pivot bore 54 is generally heart-shaped, although other noncircular shapes are contemplated for achieving the dual pivot points and the above-described disengagement.

Referring now to FIGS. 1 and 2, another feature of the present front plate 26 is at least one aiming formation 72 for facilitating the location of the nosepiece assembly 12, and specifically the lower end 18 relative to the workpiece 20 for accurate placement of fasteners 16. The aiming formation resembles the rear sight of a firearm, and defines a pair of bars between which the fastener will be placed by the driver blade 30. Additional aiming formations are contemplated which enhance line of sight accuracy in the placement of fasteners 16.

Referring now to FIG. 2, still another feature of the present tool 10 is that the magazine 14 is provided with an indicator 74 for indicating how many fasteners are remaining just prior to the magazine becoming empty. Preferably, the present indicator 74 will not be effective until there are only about 15 or fewer fasteners left in the magazine 14, with the number varying depending on the type and size of fastener employed in the tool 10.

More specifically, the preferred form of the indicator 74 utilizes a follower 76 which is a known component of magazines, being used to exert the spring force upon the strip of fasteners to urge them toward the aperture 46. The magazine 14 also includes at least one window 78 which provides a rough indication of the number of fasteners remaining, and may also be provided with a visual indicator or scale 80 of the number of remaining fasteners. As the number of fasteners 16 in the magazine 14 dwindles, the follower 74 will become visible through the window 78. It is preferred that the indicator 74 take the form of a series of spaced dots or marks 82, each representing a fastener. As the dots 82 disappear behind a wall 86 of the magazine 14 as the follower approaches the aperture 46, the user can count the remaining dots to determine the number of remaining fasteners. It is also preferred that the very last dot 84, representing the last fastener in the magazine 14, be differentiated as by size or color, from the other dots, to alert the user to reload the magazine. It is also preferred that a reference line 88 is provided on the magazine wall 86 associated with, and preferably adjacent the row of dots 82 to facilitate the user's identification of the number of remaining fasteners 16.

Figure 8:
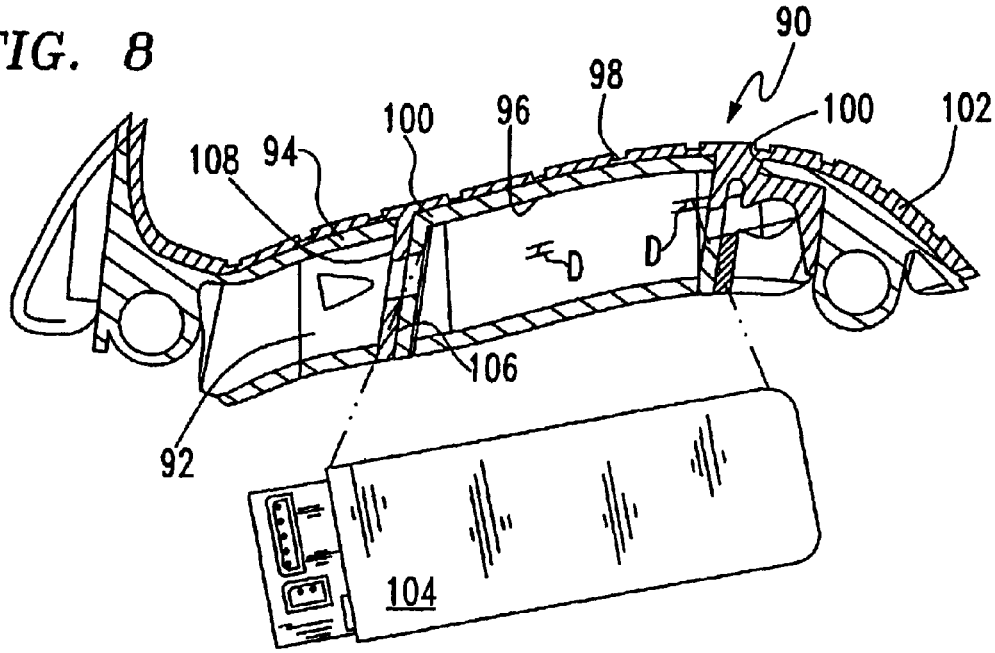
FIG. 8 is a vertical section of the handle portion showing the electronic sending unit exploded away.
Figure 9:
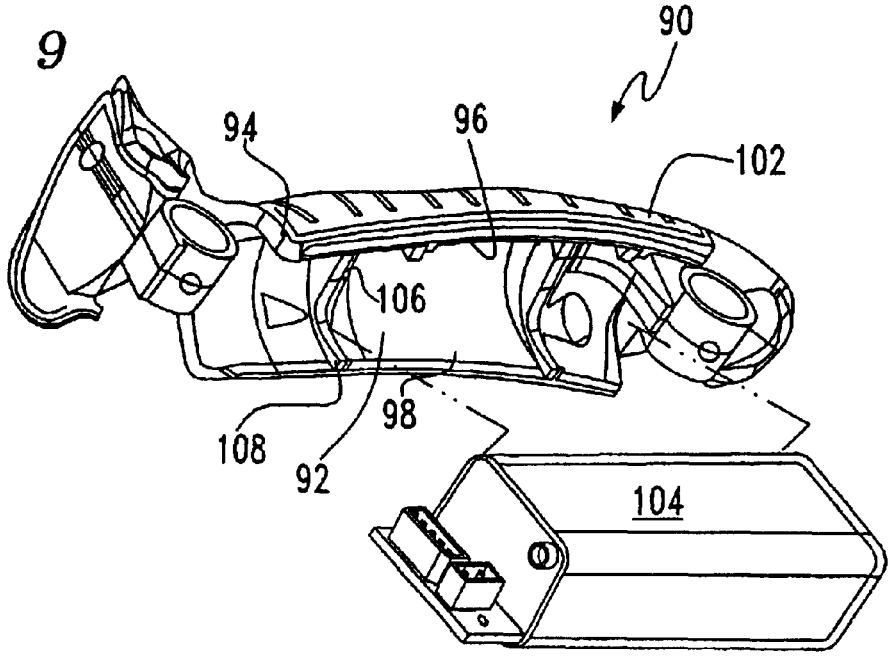
FIG. 9 is a perspective view of the embodiment of FIG. 8.

Referring now to FIGS. 8 and 9, another feature of the present tool 10 relates to the construction of a handle portion 90 which provides a grip for the user, and which also defines a chamber 92. The handle portion 90 includes an outer surface 94 for providing the grip, and an inner surface 96 for defining the chamber 92.

In the preferred embodiment, the handle portion 90 more specifically includes a relatively stiff or rigid substrate 98 defining the inner surface 96 end in the chamber 92, and having at least one aperture 100, and an overmold 102 configured for forming a gripping surface on the outer surface 94. An important feature of the present handle portion 90 is that the overmold 102 is configured for extending through the at least one aperture 100 into the chamber 92.

As is known in the art, tools of many types, and other consumer articles are made with overmolds of relatively more resilient material to enhance gripping. Using known molding technology, the substrate 98 is made of a relatively stiff or rigid material, such as ABS polycarbonate, or the like, and the overmold 102 is made of a relatively resilient material, such as an elastomer. As an example only of the relative resiliencies of the substrate 98 and the overmold 102, the preferred substrate has an approximate Durometer Shore Hardness of 85, and the overmold approximately 45. Although many materials are suitable, provided they have the desired resilience, a preferred overmold material, due to its ability to bond well with ABS polycarbonate, is provided by Diamond Polymer of Ohio, under the trademark SOFT FLEX.

While it is well known to provide gripping surfaces by overmolding, an additional feature of the present handle assembly 90 is that the overmold 102 also provides a shock absorbing function to an article located within the chamber 92 remotely from the driver blade 30 and the internal combustion engine, such as the electronic sending unit 104 of the present tool 10. More specifically, during the molding process, the overmold 102 flows through the apertures 100 and forms along already existing structural support ribs 106, to form a cushion distance 'D' by projecting past and preferably radially inwardly beyond the two spaced, relatively stiff ribs 106. As seen in FIG. 8, the ribs 106 project at an oblique angle to the inner surface 96. In this manner, the overmold 102 forms at least one resilient mounting point 108 and as depicted, two such spaced points 108 for the sending unit 104.

As best seen in FIG. 9, the ribs 106 are generally "U"-shaped to partially circumscribe the sending unit 104 and more snugly retain it within the chamber 92. Through the use of the overmold 102 creating the resilient mounting points 108, a tight friction fit is provided for the sending unit 104 which also protects against shock impact, and is an integral piece of the gripping surface on the outer surface 94.

Thus, it will be seen that the present tool 10 features a pivot stop/disengagement mechanism for providing both an open position and an interim, deflecting position. The former is useful for clearing difficult jams and/or jams of larger fasteners, and the latter is useful for deflecting stray fasteners released during the clearance of more normal jams. In addition, an indicator has been provided on the magazine follower which accurately indicates the number of fasteners remaining just before the magazine becomes empty. Further, the handle portion is configured so that the same resilient material forms a soft grip, while providing a shock absorbing function to fragile components located within the handle portion.

While specific embodiments of the trim-type fastener driving tool of the present invention have been shown and described, it will be appreciated by those skilled in the art that changes and modifications may be made thereto without departing from the invention in its broader aspects and as set forth in the following claims.

What is claimed is:

1. A powered tool constructed to axially drive a driver blade to impact and drive a fastener into a workpiece, comprising:

a handle portion with an outer surface at least partially defining a grip, and an inner surface at least partially defining a chamber located remotely from the driver blade;

said handle portion including a substrate having at least one aperture, and an overmold configured for forming a gripping surface on said outer surface, said overmold also being configured for extending through said at least one aperture into said chamber for forming at least one resilient mounting point; and at least one support rib in said chamber for engaging an electronic sending unit, said overmold extending through said at least one aperture beyond an inner edge of said at least one rib to form a cushion distance from said at least one rib to provide a tight friction fit and shock absorbing to the electronic sending unit located within said chamber for absorbing shock forces associated with the driving of the driver blade and generated remotely of the electronic sending unit.

2. The tool of claim 1 wherein said substrate is made of a first material, and said overmold is made of a second material, said second material being more resilient than said first material.

3. The tool of claim 1 wherein said at least one support rib is "U"-shaped, said overmold projects radially beyond inner edges of said rib and wherein said support rib projects at an oblique angle from said gripping surface.

4. The tool of claim 1 further including a magazine for dispensing fasteners to a nosepiece assembly, said magazine being provided with an indicator for indicating how many fasteners are remaining just prior to the magazine becoming empty.

5. The tool of claim 1 wherein said at least one support rib comprises at least two spaced support ribs for engaging said electronic sending unit in at least two points.

6. A combustion powered tool provided with an internal combustion engine and constructed to axially drive a driver blade to impact and drive a fastener into a workpiece, comprising:

a handle portion with an outer surface at least partially defining a grip, and an inner surface at least partially defining a chamber located remotely from the engine;

said handle portion including a substrate having at least one aperture, and an overmold configured for forming a gripping surface on said outer surface, said overmold also being configured for extending through said at least one aperture into said chamber for forming at least one resilient mounting point;

a pair of spaced, generally U-shaped support ribs formed in said chamber for engaging an electronic sending unit at two spaced points, said overmold extending through said at least one beyond an inner edge of aperture each of said ribs to form a cushion distance from each of said ribs at each of said space points for providing a tight friction fit and absorbing shocks remotely generated by the engine cushion the electronic sending unit.

* * * * *